US005689928A

United States Patent [19]

Rasksen

[11] Patent Number: 5,689,928

[45] Date of Patent: Nov. 25, 1997

[54] ROOF DRAIN AND METHOD FOR MAKING SAME

[75] Inventor: Neil Brian Fisher Rasksen, Bolton, Canada

[73] Assignee: Metalcraft Spinning & Stamping (Tor.) Ltd., Etobicoke, Canada

[21] Appl. No.: 606,708

[22] Filed: Feb. 26, 1996

[51] Int. Cl.[6] ..... E04B 1/70

[52] U.S. Cl. ..... 52/302.1; 52/198

[58] Field of Search ..... 52/12, 198, 302.1; 210/163, 164, 165, 166, 453; 285/40; 405/36, 52, 127

[56] References Cited

U.S. PATENT DOCUMENTS

| | | | |
|---|---|---|---|
| 1,601,498 | 2/1926 | Hirshstein . | |
| 1,999,277 | 4/1935 | Boosey | 285/37 |
| 2,079,269 | 5/1937 | Williams | 138/32 |
| 2,094,434 | 9/1937 | Sherriff | 182/31 |
| 2,859,875 | 11/1958 | Wilkie | 210/163 |
| 3,321,080 | 5/1967 | Pansini et al. | 210/163 |
| 3,378,858 | 4/1968 | Jacuzzi | 4/172 |
| 3,884,809 | 5/1975 | Logsdon | 210/163 |
| 4,112,691 | 9/1978 | Ebeling | 405/119 |
| 4,460,462 | 7/1984 | Arneson | 210/163 |
| 4,487,690 | 12/1984 | Logsdon | 210/163 |
| 5,234,582 | 8/1993 | Savoie | 210/163 |
| 5,394,657 | 3/1995 | Peterson | 52/302.1 |
| 5,469,670 | 11/1995 | Thaler | 52/12 |

FOREIGN PATENT DOCUMENTS

| | | | |
|---|---|---|---|
| 3603878 | 9/1986 | Germany | 210/163 |
| 1594951 | 8/1981 | United Kingdom | 52/302.1 |
| 94/18414 | 8/1994 | WIPO | 52/302.1 |

*Primary Examiner*—Carl D. Friedman
*Assistant Examiner*—Creighton Smith
*Attorney, Agent, or Firm*—Bereskin & Parr

[57] ABSTRACT

A roof drain for draining rain water from a flat roof comprises a conduit, with a roof flange, a strainer for straining debris from the water entering the drain, having an openable cap. The roof flange extends peripherally outwardly around the top of the conduit, and provides a connection between the surface of the roof. The conduit provides a connection with a drainage pipe located beneath the surface of the roof. The roof flange has a flat outer top surface and an recessed inner portion with a shoulder connecting the inner and outer portions of the roof flange. The strainer includes a hollow strainer basket with open bottom and top faces and side walls containing a plurality of apertures, and a strainer flange extending peripherally outwardly around the bottom edge of the side walls of the strainer basket. The outside dimension of the strainer flange is sized to fit within the recessed portion of the roof flange. The shoulder of the roof flange is crimped over the strainer flanger to non-removably rigidly couple the strainer to the roof flange. The openable cap provides selective access to the interior of the strainer to facilitate periodic cleaning and maintenance of the interior of the roof drain.

11 Claims, 6 Drawing Sheets

ROOF DRAIN AND METHOD FOR MAKING SAME

FIELD OF THE INVENTION

The present invention relates to roof draining devices that drain rain water from a flat roof, and methods for making same.

BACKGROUND OF THE INVENTION

Buildings with flat roofs are susceptible to a build up of rain water on the roof, known as ponding. It is well known that ponding can lead to premature deterioration of the roof which may result in leakage. To prevent ponding, it is a common practice to install roof drains to remove excess water from the roof surface.

Conventional roof drains typically consist of several components, including a dome-shaped strainer basket, with vertical slots on all sides, typically bolted by a number of fasteners to a water collection pan shaped to connect to a drainage pipe. The components must be assembled as the drain is being installed in the roof.

A multi-component roof draining device which requires assembly during installation has several disadvantages. Assembly of the device during installation requires extra time and effort to be expended by the installer. The complexity of the device may also require that installation be performed by a skilled labourer, such as a plumber. The use of fasteners to secure the components together increases the unit cost of conventional roof drains. Also, since fasteners are sometimes inadvertently dropped or misplaced during installation, installation costs may also be increased.

The foregoing disadvantages are magnified by the fact that a typical flat roof of an industrial building requires a multitude of roof drains to ensure proper drainage. Therefore, the increased cost and time required to install conventional roof drains are amplified.

Another disadvantage of multi-component roof drains is their susceptibility to vandalism. The flat roofs of industrial, commercial, and apartment buildings offer an enticing playground for mischief-makers. The presence of detachable fasteners makes existing roof drains vulnerable to unwanted tampering.

There is accordingly a need for a roof drain which can be inexpensively produced, which can be easily and quickly installed with a minimum of skill and effort, and which is resistant to vandalism.

SUMMARY OF THE INVENTION

The present invention relates to a roof drain comprising connecting means for providing connections between a roof surface and a drainage pipe contained therein, straining means for straining debris from the water entering the drainage pipe, and closeable access means for facilitating periodic cleaning and maintenance.

The connecting means comprises a conduit and a roof flange. The conduit has a top and a bottom, the bottom being shaped to be coupled to the drainage pipe. The roof flange extends peripherally outwardly around the top of the conduit and has an outer portion with a flat top surface and a recessed inner portion which is connected to the outer portion by a shoulder portion.

The straining means comprises a hollow strainer basket with open bottom and top faces and side walls containing a plurality of apertures. Extending peripherally outwardly from the bottom edge of the side walls of the strainer basket is a strainer flange, the outside dimension of which is sized to fit within the recessed inner portion of the roof flange of the connecting means. The shoulder portion of the roof flange of the connecting means is crimped over the strainer flange of the straining means to non-removably rigidly couple the straining means to the connecting means.

The access means provides selective access to the interior of the straining means for maintenance operations, while otherwise closing the top face of the straining means.

The strainer flange and recessed inner portion of the roof flange are preferably substantially circular shaped such that the crimp which non-removably rigidly couples the connecting means to the straining means may be formed while rotating the connecting means and straining means on a machining tool such as a lathe. The access means preferably comprises a cap, having a peripherally outwardly extending cap flange which mates with, and is removably fastened to a top flange extending peripherally inwardly from the top edge of the strainer basket. The cap is preferably removably fastened to the strainer basket on one side by fitting the top flange within a peripheral slot in the cap, defined between an out-of-plane tongue and the cap flange, and on the other side by a threaded fastener.

The present invention is also directed towards a method for making a roof drain. Connecting means and a straining means are independently formed and non-removably rigidly coupled together by a crimp joint. The crimp joint is formed while rotating the straining means and connecting means together on a machining tool, such as a lathe, the crimp joint being formed by deforming a shoulder portion of the connecting means over a strainer flange of the straining means to non-removably rigidly couple the straining means to the connecting means.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
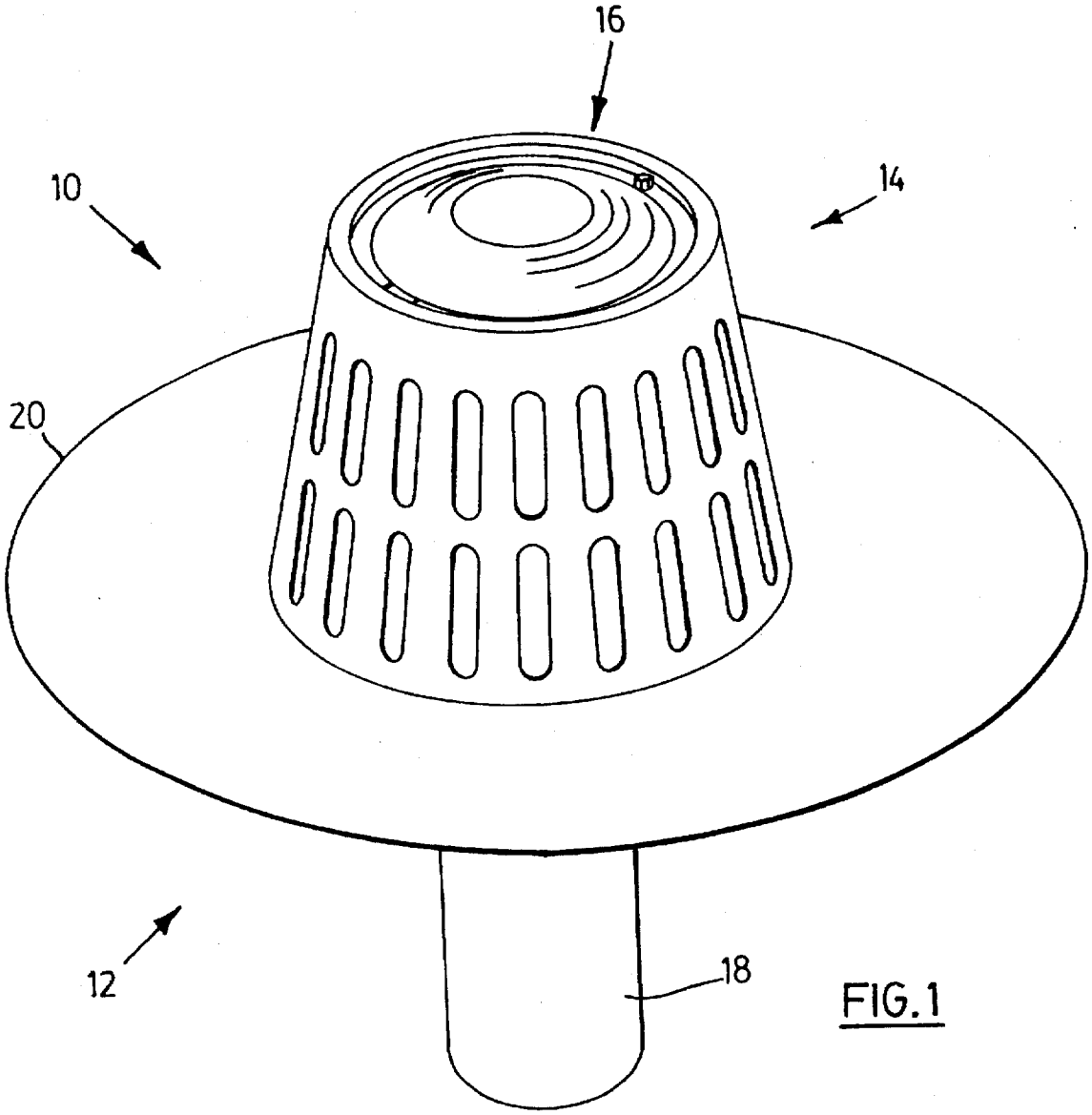
FIG. 1 is an isometric view of a preferred embodiment of the present invention.

Referring to FIG. 1, in a preferred embodiment, the present invention is a roof drain 10 comprising connecting means 12, straining means 14, and access means 16. Connecting means 12 consists of conduit 18, which provides a connection with a drainage pipe in a building, and circular roof flange 20, which provides a connection with a flat roof surface of the building. Straining means 14 strains debris from water entering the drainage pipe. Access means 16 may be opened to provide access to the interior of straining means 14 for periodic cleaning and maintenance.

Figure 2:
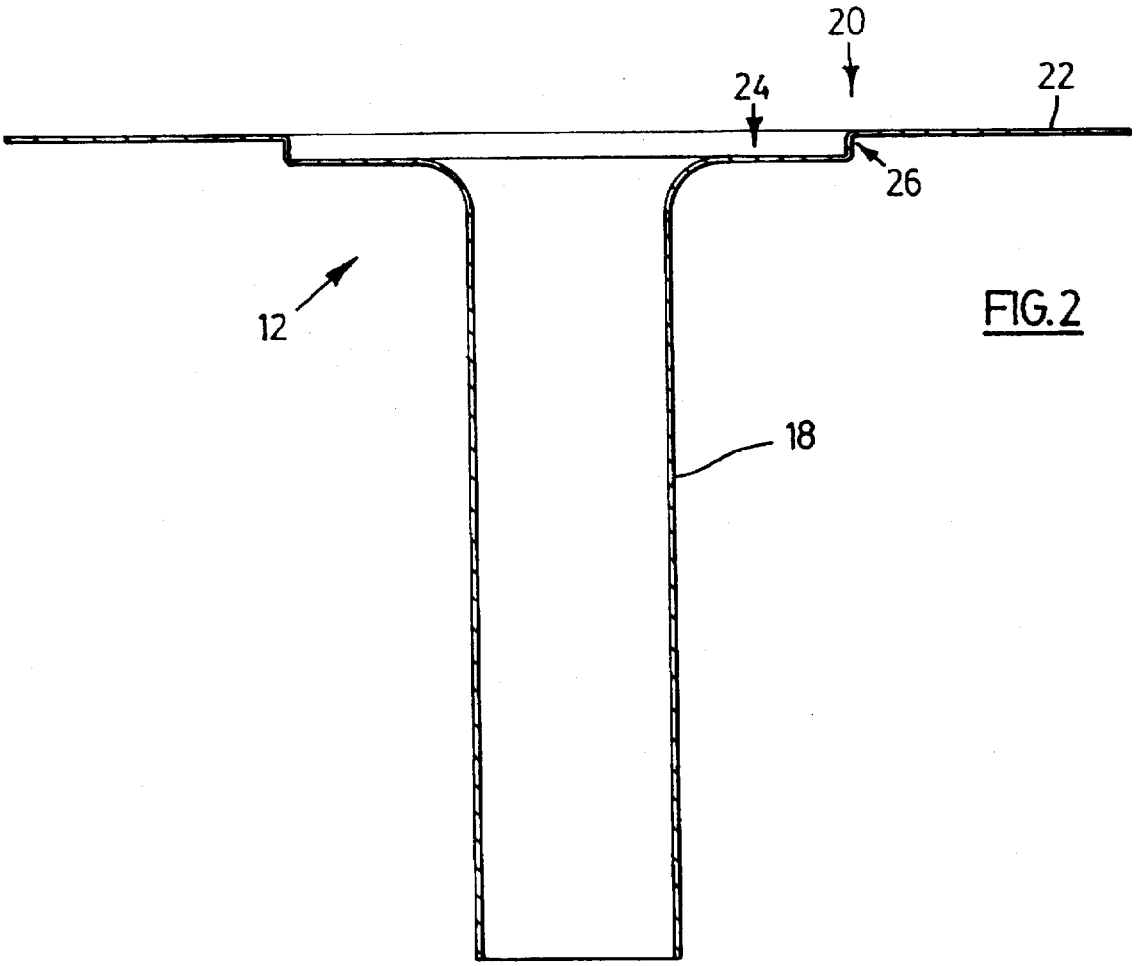
FIG. 2 is a cross-sectional side elevation of a preferred embodiment of the connecting means of the present invention, as it appears prior to assembly.

FIG. 2 shows connecting means 12 prior to assembly. Conduit 18 is of cylindrical shape and is sized to communicate with a drainage pipe of an existing plumbing system in a roof. Roof flange 20 has an outer top surface 22 which is flat to provide a smooth contact fit with the flat roof surface. Roof flange 20 has a cylindrical inner recess 24 centered therein and circumferentially defined by a shoulder 26. Prior to assembly, shoulder 26 extends upwardly between the floor of recess 24 and top surface 22.

Figure 3:
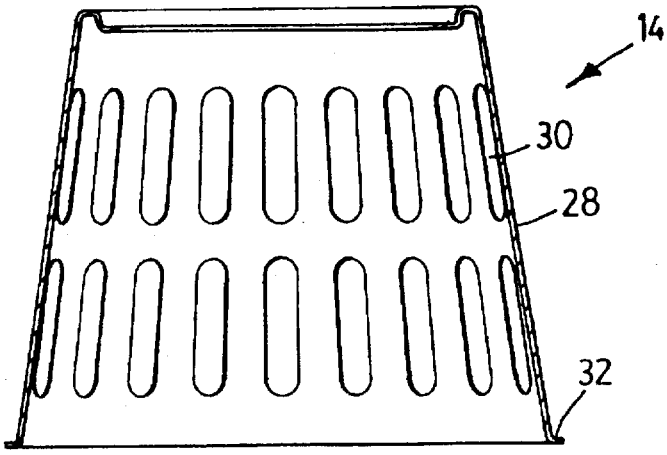
FIG. 3 is a cross-sectional side elevation of a preferred embodiment of the straining means of the present invention, as it appears prior to assembly.

Referring to FIG. 3, straining means 14 comprises a generally cylindrical strainer basket 28 with a downwardly outwardly sloping side wall having a plurality of vertical straining slots 30. Extending outwardly around the lower edge of strainer basket 28 is a circular strainer flange 32. The outer diameter of strainer flange 32 is sized to be less than the inside diameter of recess 24, such that strainer flange 32 may fit within recess 24.

Figure 4:
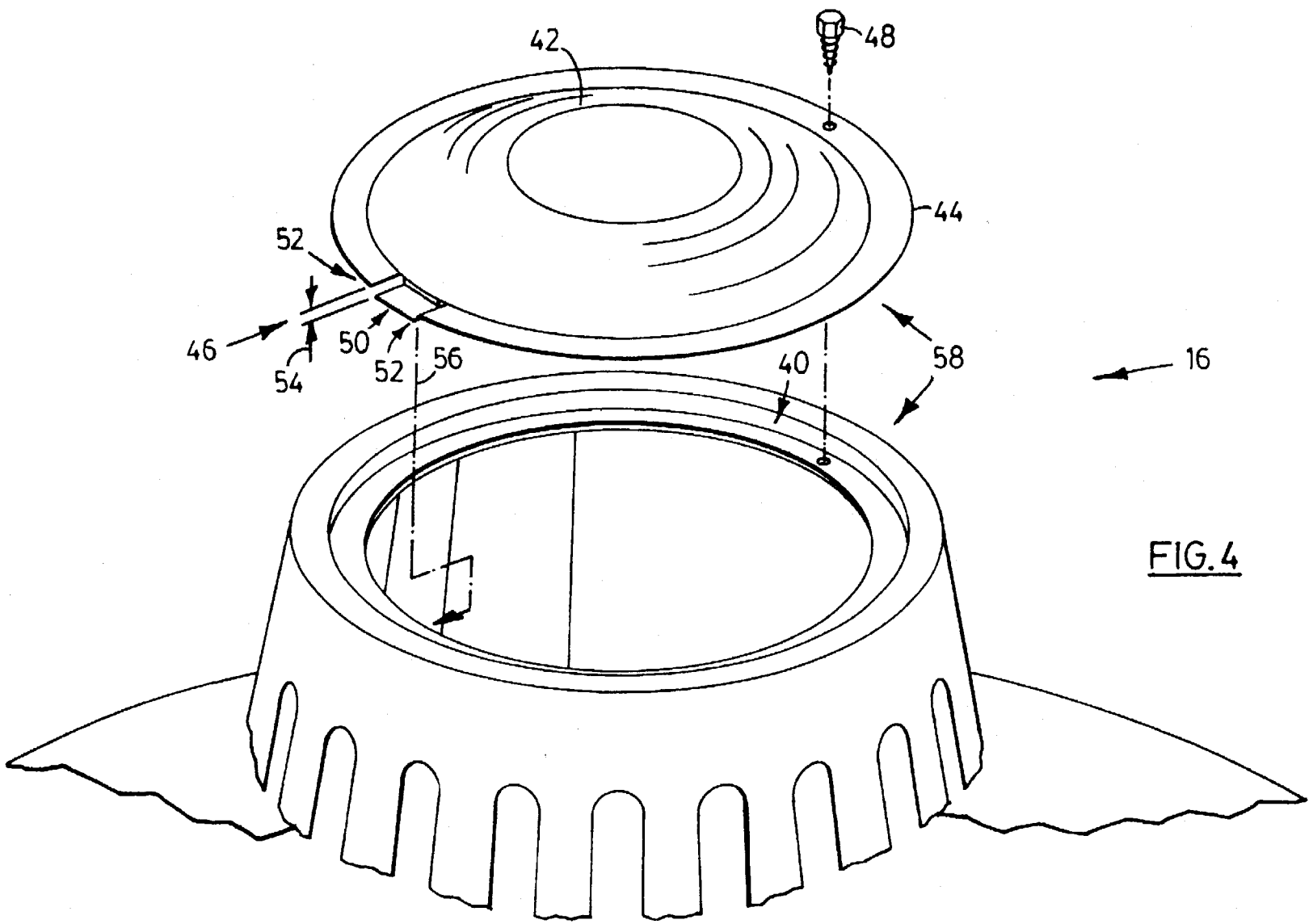
FIG. 4 is an isometric exploded view of a portion of a preferred embodiment, showing the access means.

FIG. 4 illustrates access means 16, which allows selective access to the interior of the roof drain 10 for periodic cleaning and maintenance, while otherwise closing the top of strainer basket 28. Access means 16 preferably comprises a circular opening in a top face of straining means 14, defined by a circular top flange 40 extending inwardly from the top edge of strainer basket 28, and a detachable circular cap 42 having a circular cap flange 44, dimensioned to substantially mate with top flange 40. Although it will be readily recognized that cap 42 may be fastened to top flange 40 in any number of ways, a preferred method of securing cap 42 is through the use of a detachable joint 46 and a single threaded fastener 48, such as a self-tapping screw. The main features of joint 46 is an out-of-plane tongue 50, defined by a pair of radial slots 52 in cap flange 44, and a circumferential slot 54 which is defined between tongue 50 and cap flange 44. When top flange 40 is slid into circumferential slot 54, in a manner indicated by dotted line 56, joint 46 is composed. Diametrically opposed from joint 46, fastener 48 is threaded through a pair of mating holes 58, removably securing cap 42 to straining means 14.

Figure 5:
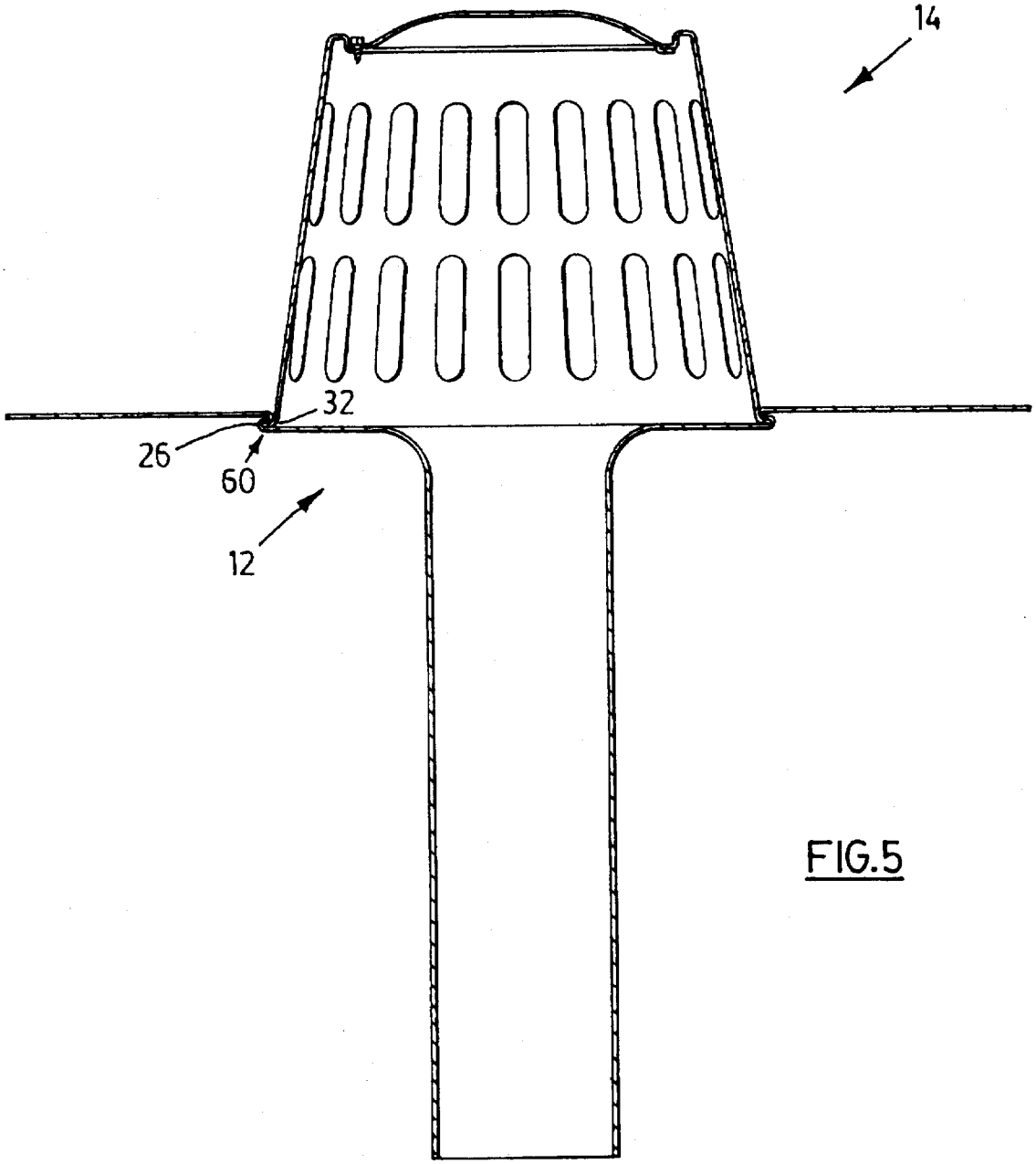
FIG. 5 is a cross-sectional side elevation of a preferred embodiment of the present invention.

As shown in FIG. 5, straining means 14 is non-removably rigidly coupled to connecting means 12 by a crimped joint 60 which is formed by crimping shoulder 26 over strainer flange 32.

Figure 6:
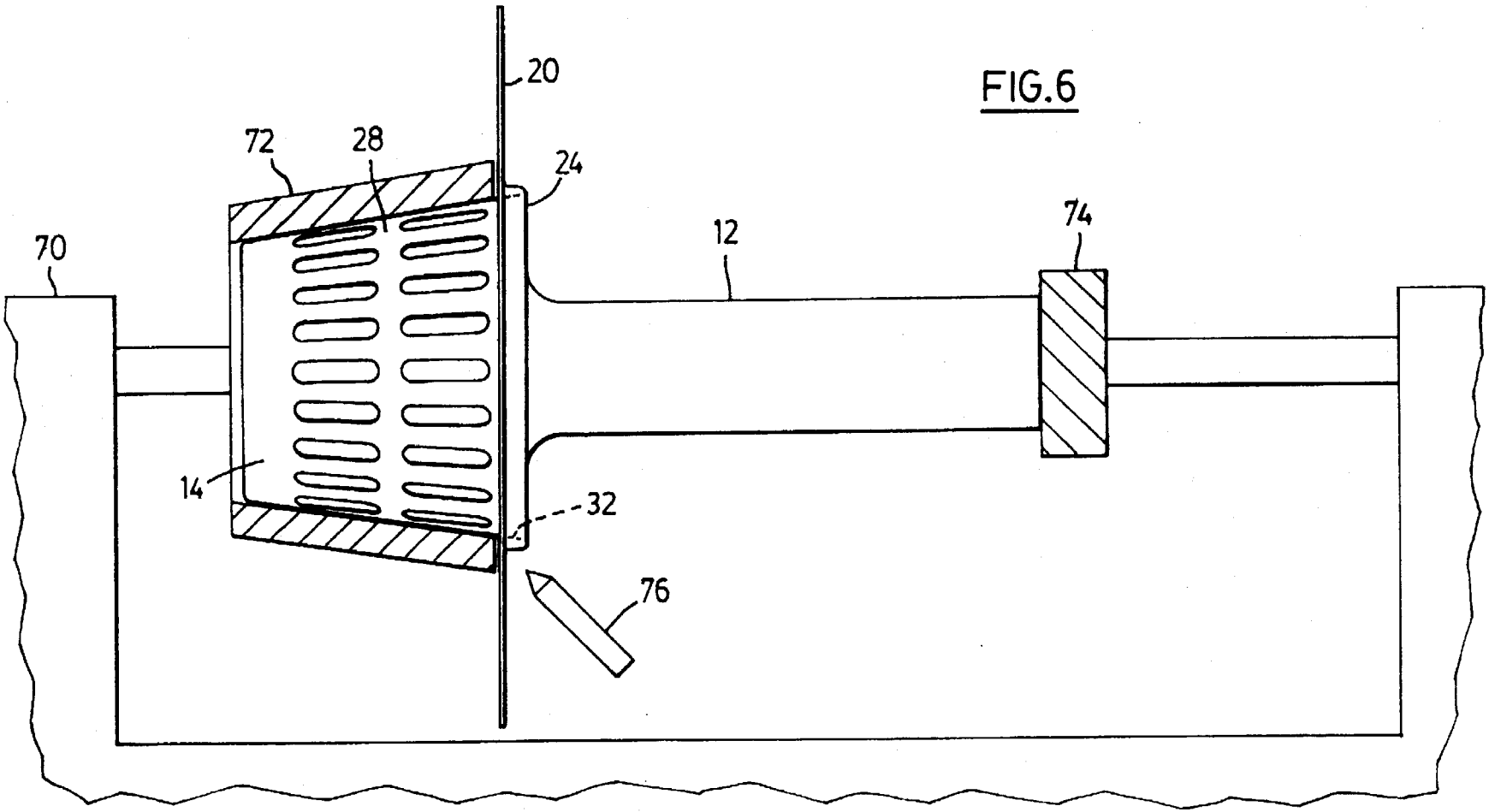
FIG. 6 is a cross-sectional side elevation of a preferred method of making the present invention.

FIG. 6 shows a preferred method of making the roof drain of the present invention. Connecting means 12 and straining means 14 are formed separately, preferably from spun aluminum, such that connecting means 12 has roof flange 20 with recess 24, and straining means 14 has strainer basket 28 with strainer flange 32. Once formed, straining means 12 is securely held in a lathe 70 by inserting strainer basket 28 into chuck 72, such that strainer flange 32 is accessible. As connecting means 12 is rotatably held between follower 74 and straining means 14, roof flange 20 is placed over strainer basket 28, such that strainer flange 32 fits within recess 24. While turning connecting means 12 and straining means 14 together on lathe 70, a forming tool 76 is steadily pressed against the outer portion of shoulder 26, in a direction generally perpendicular to the outside surface of shoulder 26, with sufficient pressure to deform shoulder 26. Pressure on tool 76 is maintained until shoulder 26 has deformed sufficiently to securely form crimp joint 60, as shown in FIG. 5.

Figure 7:
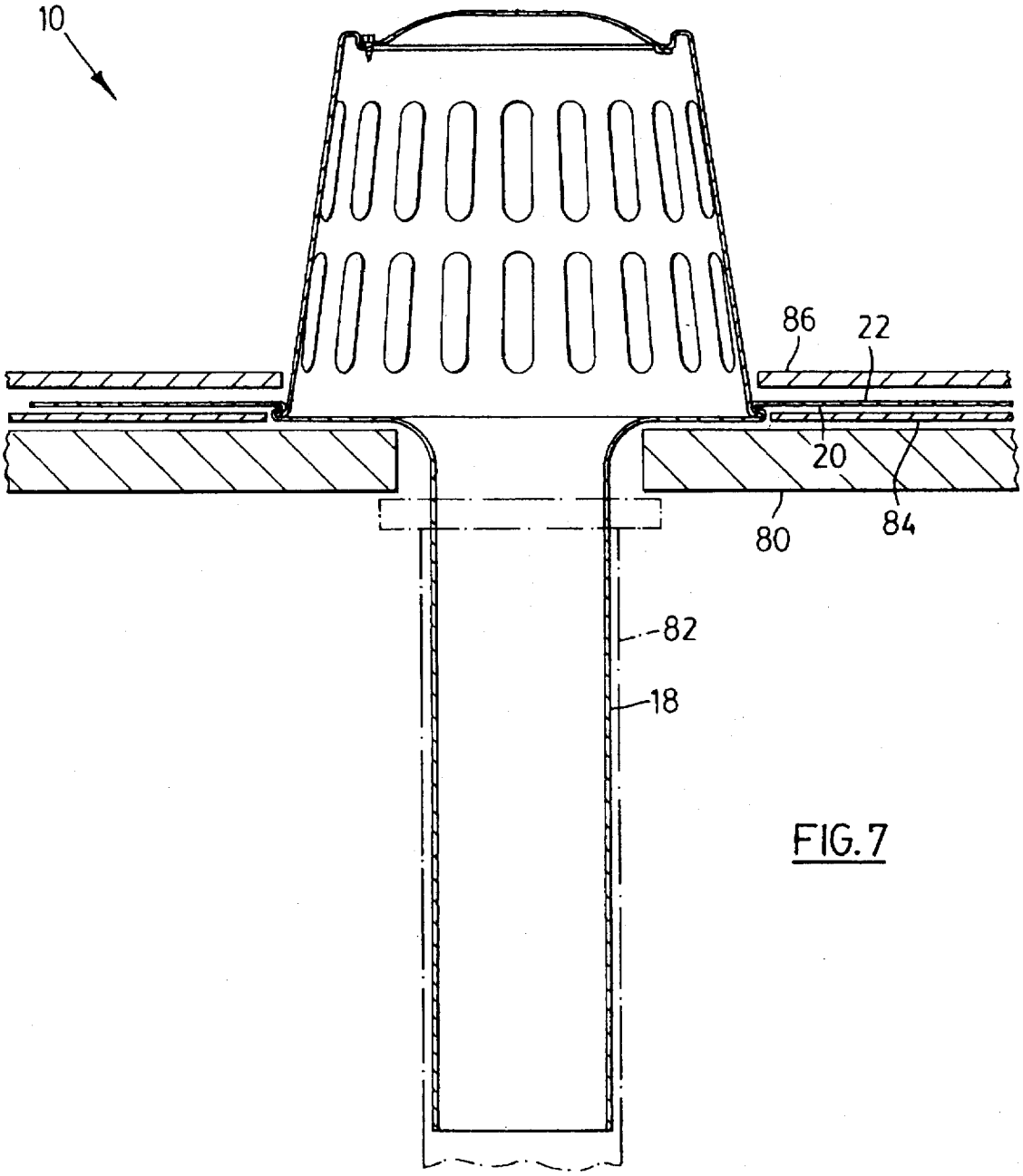
FIG. 7 is a cross-sectional side elevation of a preferred embodiment of the present invention, as it appears installed in a flat roof.

Referring now to FIG. 7, roof drain 10 is preferably installed during construction of a flat roof of a building, after laying of the roofing membrane. Roof drain 10 is installed in an opening in flat roof 80, shown in ghost lines, having a plumbing system therein with a drainage pipe 82, also shown in ghost lines. A roofing membrane 84, such as ethylene propylene diene monomer polymers (EPDM), is applied to roof 80, and holes, sized to be larger than conduit 18 are cut therein. Roof drain 10 is positioned in the opening in roof 80 with roof flange 20 firmly seated in contact with roofing membrane 84 and conduit 18 mated with drainage pipe 82. Conduit 18 is then coupled in an appropriate fashion to drainage pipe 82. Gravel or tar 86 is then placed on top of top surface 22 of roof flange 20.

When compared to conventional roof drains, the roof drain of the present invention is believed to be simpler to install, facilitating quicker installation and reducing the required skill level of the installer. The subject roof drain is also believed to be cheaper to manufacture than conventional roof drains and is substantially tamper-proof. The method of the present invention is believed to be simple and facilitates the manufacture of the pre-assembled design of the subject roof drain.

While the preferred embodiment described above has a generally circular geometry, it will readily be acknowledged that the device of the present invention could be easily adapted to a square or rectangular geometry.

Accordingly, it should be apparent to persons skilled in the art that various modifications and adaptations of the structure described above are possible without departure from the present invention, the scope of which is defined in the appended claims.

I claim:

1. A device that drains water from a flat roof surface, said roof surface having a drainage pipe located there below, comprising:

(a) connecting means for providing connections between the roof surface and the drainage pipe, comprising a conduit having a top and a bottom, the bottom being shaped to be coupled to the drainage pipe, and a roof flange extending peripherally outwardly around the top of the conduit having an outer portion with a flat top surface and a recessed inner portion connected to the outer portion by a shoulder portion;

(b) straining means for straining debris from the water entering the drainage pipe, comprising a strainer basket having a substantially hollow interior, an open bottom face, an open top face, side walls having a top edge and a bottom edge and containing a plurality of apertures, and a strainer flange extending peripherally outwardly around the bottom edge of the side walls having an outside dimension sized to fit within the recessed inner portion of the roof flange, wherein the shoulder portion of the roof flange is crimped over the strainer flange to non-removably rigidly couple the straining means to the connecting means; and (c) closeable access means for closing the top face of the straining means and providing selective access to the interior of the straining means.

2. The device of claim 1 wherein the straining means further comprises a top flange extending peripherally inwardly from the top edge of the side wall of the straining means, and the access means comprises a cap having a peripherally outwardly extending cap flange dimensioned to substantially mate with the top flange, said cap flange lying in a plane, and cap securing means for removably securing the cap to the straining means.

3. The device of claim 2 wherein the cap securing means comprises a tongue defined by a pair of radial slots in the cap flange of the cap, the tongue being downwardly disposed from the plane of the cap flange, the cap being detachably joined to the straining means by locating the tongue below the top flange of the straining means and by inserting a threaded fastener through a hole in the cap flange and into a threaded aperture in the top flange to releasably fix the cap to the straining means.

4. A device that drains water from a flat roof surface, said roof surface having a drainage pipe located there below, comprising:

(a) connecting means for providing connections between the roof surface and the drainage pipe comprising a substantially cylindrical conduit having a top and a bottom, the bottom being shaped to be coupled to the drainage pipe, and a roof flange extending peripherally outwardly around the top of the conduit having an outer portion with a flat top surface and a substantially cylindrical recessed inner portion connected to the outer portion by a shoulder portion;

(b) straining means for straining debris from the water entering the drainage pipe, comprising a strainer basket having a substantially hollow interior, an open bottom face, an open top face, side walls having a top edge and a bottom edge and containing a plurality of apertures, and a substantially circular strainer flange extending peripherally outwardly around the bottom edge of the side walls having an outside dimension sized to fit within the substantially cylindrical recessed inner portion of the roof flange, wherein the shoulder portion of the roof flange is crimped over the strainer flange to non-removably rigidly couple the straining means to the connecting means; and (c) closeable access means for substantially closing the top face of the straining means and providing selective access to the interior thereof.

5. The device of claim 4 wherein the straining means further comprises a substantially circular top flange extending peripherally inwardly from the top edge of the side walls of the straining means, and the access means comprises a substantially circular cap having a substantially circular peripherally outwardly extending cap flange dimensioned to substantially mate with the top flange, said cap flange lying in a plane, and cap securing means for removably securing the cap to the straining means.

6. The device of claim 5 wherein the cap securing means comprises a tongue defined by a pair of radial slots in the cap flange of the cap, the tongue being downwardly disposed from the plane of the cap flange, the cap being detachably joined to the straining means by locating the tongue below the top flange of the straining means and by inserting a threaded fastener through a hole in the cap flange into a threaded aperture in the top flange to releasably fix the cap to the straining means.

7. The roof drain of claim 4 wherein the connecting means and straining means are made of spun aluminum.

8. A method for making a roof drain that drains water from a flat roof surface, said roof surface having a drainage pipe located there below, comprising the steps of:

(a) forming connecting means for providing connections between the roof surface and the drainage pipe, the connecting means having a connector flange with centered recessed portion therein peripherally defined by a shoulder portion;

(b) forming a straining means for straining debris from the water entering the drainage pipe, the straining means having side walls with a bottom edge and a strainer flange extending peripherally outwardly around the bottom edge of the side walls;

(c) rotatably securely holding the straining means such that the strainer flange is accessible;

(d) placing the connecting means against the strainer flange such that the strainer flange of the straining means is seated within the recessed portion of the connector flange; and (e) deforming the shoulder portion until the shoulder portion is crimped over the strainer flange, so as to non-removably rigidly couple the straining means to the connecting means.

9. A method according to claim 8 wherein the step of deforming the shoulder portion comprises turning the connecting means and straining means together and steadily pressing inwardly against the shoulder portion of the connector flange with sufficient pressure to deform the shoulder portion.

10. A method for making a roof drain that drains water from a flat roof surface, said roof surface having a drainage pipe located there below, comprising the steps of:

(a) forming a straining means for straining debris from the water entering said drain, the straining means having side walls with a bottom edge and a strainer flange extending peripherally outwardly around the bottom edge of the side walls;

(b) forming connecting means for providing connections between the roof surface and the drainage pipe, the connecting means having a connector flange;

(c) forming a centered recessed portion within said connector flange, said recessed portion being sized to receive the strainer flange of the straining means and said recessed portion being peripherally defined by a shoulder portion; and (d) with the strainer flange of the straining means placed within the recessed portion of the connector flange, deforming the shoulder portion until the shoulder portion is crimped over the strainer flange, so as to non-removably rigidly couple the straining means to the connecting means.

11. A roof drain that drains water from a flat roof surface, said roof surface having a drainage pipe located there below, said roof drain being formed by a method comprising the steps of:

(a) forming a straining means for straining debris from the water entering said drain, the straining means having side walls with a bottom edge and a strainer flange extending peripherally outwardly around the bottom edge of the side walls;

(b) forming connecting means for providing connections between the roof surface and the drainage pipe, the connecting means having a connector flange;

(c) forming a centered recessed portion within said connector flange, said recessed portion being sized to receive the strainer flange of the straining means and said recessed portion being peripherally defined by a shoulder portion; and (d) with the strainer flange of the straining means placed within the recessed portion of the connector flange, deforming the shoulder portion until the shoulder portion is crimped over the strainer flange, so as to non-removably rigidly couple the straining means to the connecting means.

* * * * *